US008746503B2

(12) United States Patent
Lim et al.

(10) Patent No.: US 8,746,503 B2
(45) Date of Patent: Jun. 10, 2014

(54) SYSTEM AND METHOD FOR PROVIDING A RESERVE SUPPLY OF GAS IN A PRESSURIZED CONTAINER

(76) Inventors: Walter K. Lim, Rancho Santa Fe, CA (US); Arthur A. Krause, Winnetka, CA (US)

( * ) Notice: Subject to any disclaimer, the term of this patent is extended or adjusted under 35 U.S.C. 154(b) by 1365 days.

(21) Appl. No.: 11/250,235

(22) Filed: Oct. 14, 2005

(65) Prior Publication Data

US 2006/0049215 A1 Mar. 9, 2006

Related U.S. Application Data

(63) Continuation-in-part of application No. 10/866,451, filed on Jun. 12, 2004, now Pat. No. 7,185,786.

(60) Provisional application No. 60/650,338, filed on Feb. 4, 2005.

(51) Int. Cl.
*B67D 7/00* (2010.01)

(52) U.S. Cl.
USPC ..... 222/3; 222/187; 222/399; 222/402.1

(58) Field of Classification Search
USPC ..... 222/3, 386.5, 389, 394, 399, 187, 402.1
See application file for complete search history.

(56) References Cited

U.S. PATENT DOCUMENTS

| | | | | |
|---|---|---|---|---|
| 3,964,649 | A * | 6/1976 | Alexander | 222/399 |
| 3,992,493 | A * | 11/1976 | Whyte et al. | 261/121.1 |
| 4,049,158 | A * | 9/1977 | Lo et al. | 222/95 |
| 4,182,688 | A | 1/1980 | Murtaugh | |
| 4,518,103 | A | 5/1985 | Lim et al. | |
| 4,679,706 | A * | 7/1987 | Magid et al. | 222/130 |
| 5,009,340 | A | 4/1991 | Morane | |
| 5,032,619 | A | 7/1991 | Frutin et al. | |
| 5,054,651 | A | 10/1991 | Morane | |
| 5,256,400 | A * | 10/1993 | Froix et al. | 424/45 |
| 5,301,851 | A | 4/1994 | Frutin | |
| 5,398,850 | A * | 3/1995 | Sancoff et al. | 222/386.5 |
| 5,912,424 | A | 6/1999 | Judkins et al. | |
| 5,992,700 | A * | 11/1999 | McGlothlin et al. | 222/187 |
| 6,030,698 | A | 2/2000 | Burchell et al. | |
| 6,360,923 | B1 | 3/2002 | Vlooswijk | |
| 6,527,150 | B2 * | 3/2003 | Benoist | 222/402.1 |

(Continued)

FOREIGN PATENT DOCUMENTS

| | | |
|---|---|---|
| EP | 0569590 | 11/1993 |
| GB | 1206791 | 9/1970 |
| GB | 1542322 | 3/1979 |

*Primary Examiner* — Paul R Durand
*Assistant Examiner* — Andrew P Bainbridge

(57) ABSTRACT

A gas storage and delivery system for restoring pressure as it is depleted from a pressurized container, includes a container holding a product under pressure to be dispensed from the container, a quantity of gaseous material under pressure, occupying a space in the container and applying to the product a predetermined pressure of from about 30 to about 180 psig, and a quantity of gas-adsorbing material, storing under pressure a quantity of the gaseous material and releasing it into the container in response to a decrease in pressure in the container, thereby restoring and maintaining a predetermined pressure in the container as product is depleted from the container, wherein the gas-adsorbing material is wetted with a release-promoting agent to promote release of the sorbed gas from the gas-adsorbent material. A process of filling the container is also disclosed.

24 Claims, 11 Drawing Sheets

(56) References Cited

U.S. PATENT DOCUMENTS 6,602,466 B2 * 8/2003 Hamilton et al. ..... 422/37
6,607,696 B1 * 8/2003 Hamilton et al. ..... 422/37
6,708,844 B2 3/2004 Lim et al.
6,745,922 B1 6/2004 Vlooswijk et al.
6,770,118 B2 * 8/2004 Stolyarevsky ..... 95/90
7,185,786 B2 * 3/2007 Krause et al. ..... 222/1

* cited by examiner

SYSTEM AND METHOD FOR PROVIDING A RESERVE SUPPLY OF GAS IN A PRESSURIZED CONTAINER

This application claims the benefit of U.S. Provisional Patent Application Ser. No. 60/650,338, filed Feb. 4, 2005, and is a continuation-in-part of U.S. application Ser. No. 10/866,451, filed Jun. 12, 2004 now U.S. Pat. No. 7,185,786.

BACKGROUND OF THE INVENTION

1. Field of the Invention

This invention relates generally to pressurized dispensing containers, and more particularly, to a system and method for providing a reserve supply of gas in a pressurized container, and especially to a system and method for storing gases adsorbed or absorbed on a sorbent material such as, e.g., activated carbon, zeolite, or molecular sieves, in pressurized containers, and subsequently releasing the sorbed material in response to a decrease in pressure below a predetermined level in the container. In one aspect, the reserve supply of gas is used to restore and maintain propellant pressure as the dispensed product and/or propellant are depleted from a pressurized dispensing container, to thereby improve the useful service life of the system. In another aspect, the invention relates to the replenishment of a carbonization gas in a carbonated beverage, or to the addition of a supplement, e.g., oxygen, to a beverage. The invention also relates to a process for filling and/or pressurizing such containers.

2. Prior Art

Pressurized containers are commonly used to dispense many products, including paint, lubricants, cleaning products, food items, personal care products such as hair spray, and the like. These containers include systems in which the product and propellant are stored separately in a container, i.e., separated by a barrier, e.g. a piston or bag, commonly referred as a barrier pack system, and systems in which the product and a suitable propellant are stored together under pressure in the container. Dispensing of the product occurs when a discharge valve or nozzle is opened, permitting the pressurized product to be forced out through the nozzle, usually as a spray, stream, or foam. As product is depleted from the container, the pressure exerted by the propellant decreases, especially evident when compressed gases are used as the propellant, and the propellant pressure may become diminished to the extent that all of the product cannot be dispensed from the container, or desired characteristics, e.g., atomization, are not achieved.

In addition to the propellant component, many products, e.g., hair spray, require a carrier, e.g., alcohol, or combinations of alcohol with water or other volatile solvents that dry quickly upon discharge from the container. Other volatile solvents that can be used in these systems include volatile organic compounds (VOCs) such as propane, isobutane, dimethyl ether, and the like, but their use is limited due to environmental concerns. For instance, under some current regulations no more than 55% of the contents of the container can comprise a VOC. In an aerosol dispenser, as much as 25% of the VOC could be required for use as a propellant, leaving about 30% VOC in the product. The balance of the product would be the active ingredient and water, which does not dry as quickly as the VOC, resulting in a "wet" product when used.

Carbon dioxide ($CO_2$) is environmentally friendly, and is therefore useful as an aerosol propellant, but its use has been limited due to the fact that it is normally placed in the container as a pressurized or compressed gas, and the drop-off in pressure is excessive as the product is used. For example, in a typical situation the starting pressure might be 100 psig and the finishing pressure only 30 psig. At this low finishing pressure all of the product may not be discharged, and/or proper atomization may not be achieved.

Other systems relying upon gas pressure to discharge a product include cans of pressurized gas that are intended for use in cleaning dust and the like from sensitive equipment, such as computers, computer keyboards, etc., by blowing a pressurized stream of the gas onto the equipment. Using compressed carbon dioxide as the gas in these systems is not entirely satisfactory because of the rapid fall-off in pressure as the gas is used. Accordingly, other gases, such as fluorocarbon (e.g., Dymel® by DuPont), are sometimes used in these systems. However, these materials are relatively expensive for the intended use.

Conventional barrier pack systems typically comprise acan made of aluminum, steel, plastic, or other suitable material, with a barrier in the can between the product and the propellant. The barrier normally comprises a piston reciprocable in the can, or a collapsible bag in which the product is contained. Empty cans, either with a piston in place in the can, or a bag attached to the valve or dome closing the end of the can, are commonly shipped from the can manufacturer to a location where the can is to be filled.

If the barrier pack is of the type having a piston, the filler normally introduces product, e.g., a gel, into the can above the piston. The aerosol valve is then fitted and sealed to the can, and a liquefied propellant such as, e.g., isobutene, a VOC, is introduced under a predetermined pressure into the can beneath the piston through a sealing plug in the bottom of the can. Some of the liquefied propellant vaporizes until an equilibrium pressure is reached. The pressurizing propellant forces the piston up, placing pressure on the product so that it is discharged through the valve when the valve is opened. The amount of pressure available from the liquefied propellant is finite, and as product is depleted and the pressure drops, suitable atomization or discharge of the product may not be achieved, especially after most of the product has been discharged.

In those barrier packs utilizing a bag, the filler introduces product into the bag, and then introduces a liquefied propellant into the can around, or outside, the bag. The propellant exerts pressure on the bag, forcing product out through the valve when the valve is opened. As discussed above, suitable atomization or discharge of the product may not be achieved as product is depleted and the pressure decreases.

Other pressurized systems include carbonated beverages, and over time the carbonization decreases, resulting in a "flat" drink Various systems have been developed in the prior art for adding propellant to a container as product is depleted, so that propellant pressure is maintained at a desirable level until a suitable amount of the product is dispensed from the container. Other systems have been developed for introducing or replenishing a propellant or carbonization gas in a carbonated beverage. Exemplary of such prior art systems are those disclosed in the following US Patents: U.S. Pat. No. 3,858,764 (issued to Wilkinson Sword Ltd); U.S. Pat. No. 4,049,158 (to S.C. Johnson & Sons, Inc.); U.S. Pat. No. 4,182,688 (to The Drackett Company); U.S. Pat. No. 4,518,103 and U.S. Pat. No. 6,708,844 (to Walter K. Lim and Arthur A. Krause); U.S. Pat. No. 5,032,619 and U.S. Pat. No. 5,301,851 (to Rocep-Lusol Holdings Ltd.); U.S. Pat. No. 5,256,400 (to Advanced Polymer Systems, Inc.); U.S. Pat. No. 5,562,235 (to Rudiger Cruysberghs); U.S. Pat. Nos. 6,390,923 and 6,745,922 (to Heineken Technical Services BV); 6,527,150 (to L'Oreal SA); and 6,770,118 (to World Laboratory Complex).

U.S. Pat. No. 3,858,764 discloses a pressurized dispenser in which a reservoir formed of an organic substance (e.g., rubber) holds supplemental propellant in solution. The patent states at lines 38-44, column 4, that the material must be capable of holding the propellant in solution, as opposed to merely absorbing propellant into the pores or interstitial spaces of the material.

U.S. Pat. No. 4,049,158 discloses the placement in a pressurized container of a quantity of gas adsorbent material, e.g., activated carbon, having a quantity of gas, e.g., $CO_2$, adsorbed thereon as a reserve supply of pressurized gas to maintain a desired pressure in the container. The patent discloses several embodiments, including a barrier pack (piston or bag), and a non-barrier pack (pouch or envelope). The adsorbent material is placed in a separate pressure source chamber that can have a fixed volume and communicate with the product chamber via a check valve or a constant pressure valve, or the source chamber can be expandable, or the source chamber can be a pouch or envelope containing the adsorbent material. The adsorbent material is, in all cases, in a pressure source chamber separate from the product chamber that prevents contact between the adsorbent material and the product.

U.S. Pat. No. 4,182,688 discloses a gas-adsorbent propellant system that is intended for use to clear waste stoppages in a conduit, and essentially fills a container with adsorbent material (e.g., activated carbon) on which $CO_2$ is stored for subsequent release when the discharge valve is opened. The system is designed so that a large quantity of the gas itself is available for several discharges of one second duration at a pressure of about 30 psig.

U.S. Pat. No. 4,518,103 discloses a method and apparatus for releasing additional propellant into a pressurized container, wherein a reserve container in the primary container holds a quantity of liquefied propellant and is constructed to open or rupture as a result of a predetermined reduction in the pressure in the primary chamber, to thereby release additional propellant into the primary container. The release of additional propellant occurs essentially all at once when a predetermined pressure differential is reached.

U.S. Pat. No. 5,032,619 describes a system for storing and dispensing gas, but discloses that the stored gas can be used as a propellant. It relies upon non-rigid swellable polymers, such as, e.g., hydrogels (although zeolite is also mentioned), having microvoids in which the gas is stored. The patent describes several embodiments, including: (1) a two-phase gas/solid system in which gas is stored in the microvoids of the solid polymer; (2) a three-phase gas/liquid/solid system in which a liquid solvent of the gas occupies the microvoids (preferred solvents are identified as water and other "polar solvents"); (3) a two-phase gas/liquid system in which the gas is dissolved in a liquid solvent for the gas (examples given include $CO_2$ dissolved in acetone); (4) a pressure pack having a gas storage system according to (1), (2) or (3) above; and (5) a procedure for pressurizing a barrier-type pressure pack dispenser as described in (4) above, wherein a quantity of polymeric material (and solvent if used) are placed in a container on the side of the barrier opposite that of the product, followed by the addition of a non-gaseous form of the propellant gas (e.g., dry ice), and then sealing the container. In all cases, a barrier separates the polymer from the product (the barrier may comprise a piston or a bag, or an envelope containing the polymeric material). It is disclosed that the product could be inserted prior to or after the propellant. The "polar solvent" is disclosed as being added to promote swelling of the polymer.

U.S. Pat. No. 5,256,400 discloses a pressurized product delivery system in which a gas is sorbed in the macropores of a polymeric matrix having a pore size of from about 0.0001 μm to about 3.0 μm. The preferred polymeric material is said to be a copolymer of methyl methacrylate and ethylene glycol dimethacrylate, with the polymeric particles having a porosity of at least 30%, and preferably greater. The polymeric material is disclosed as being compressed into pellets or tablets, and the gas is described as being stored in macropores of the sorbent material. Many different possible polymers and monomers are listed, but no mention is made of activated carbon, zeolite or molecular sieve materials. The patent mentions that the product, polymer and propellant can all be in the same chamber, and in those systems a screen, filter, or the like, can be included to prevent plugging of the valve and nozzle (implying that the sorbent material will be in small particle form).

U.S. Pat. No. 5,562,235 discloses a system in which reserve propellant gas is stored under pressure in a separate pressure source chamber in the product-containing chamber, and a pressure operated valve controls flow of the reserve gas from the pressure source chamber into the product chamber. There is no suggestion of adsorption of gas onto a gas-adsorbing media.

U.S. Pat. No. 6,390,923 discloses a system for dispensing carbonated beverages, e.g., beer, in which a source of pressurized gas, e.g., $CO_2$, is contained in a separate compartment with pressure control means to control its release into the product chamber and maintain equilibrium pressure. The patent states that the process can be used for dispensing other products, but does not disclose how or what.

U.S. Pat. No. 6,527,150 discloses a system for packaging a product, particularly a cosmetic, wherein a reserve pressure source chamber is received in a translucent or transparent outer product container, and the product and pressure source chambers are separated from one another in a sealed manner. A liquefied propellant is in the pressure source chamber, and a "retainer" in that chamber traps the liquid phase of the propellant. At least one portion of the retainer is permeable to the gas phase. It is disclosed that the propellant can be a hydrocarbon, and the retainer may be an open cell foam, felt, or porous membrane, or sintered metal or silicone, located spaced from the container bottom.

U.S. Pat. No. 6,708,844 discloses a system in which a quantity of adsorbent material, e.g., activated carbon, has a quantity of gas, e.g., $CO_2$, stored thereon and is placed in a product chamber for release of the stored gas into the product as the pressure in the product chamber is depleted. The system can be used as a propellant for discharging the product, or as a source of carbonation to maintain carbonation in a carbonated beverage, or to add a supplement to a beverage. The adsorbent material may formed into a cohesive shape such as a ball or cube and placed directly in the product, or the adsorbent material may be encased in a cover that can be impermeable or permeable to the product.

U.S. Pat. No. 6,770,118 discloses a gas storage capsule and method for filling it, wherein the capsule is intended to be placed in a container holding a product to pressurize the product. Charcoal, zeolite, silica gel, or their mixtures can be placed in the capsule as a sorbent for a gas such as $CO_2$, Ar, $N_2$, $O_2$, etc.

Some of these prior art systems are relatively complex and expensive, relying upon mechanical valves or other pressure responsive devices to release the stored reserve propellant. In some cases the reserve propellant is dissolved in a solvent and stored as a liquid, while in other cases the reserve propellant is stored as a gas on a gas adsorbent material. However, a substantial amount (typically 50%) of the stored gas is not released and remains on the storage material. The efficiency of these systems is thus reduced and in order to obtain release of a desired amount of reserve propellant, excess storage material and/or propellant must be placed in the container. This then adds to the cost and inefficiency of the system.

It would be desirable to have an economical, efficient, and environmentally safe system and method for providing a reserve supply of gas in a pressurized container. In particular, it would be desirable to have a system and method for providing a reserve supply of gas to restore and maintain propellant pressure as product is depleted from a container, wherein the gas is adsorbed on a gas adsorbent material and means is provided to promote release of all or substantially all of the stored gas.

SUMMARY OF THE INVENTION

The present invention provides a system and method to replenish and maintain a desired pressure in pressurized containers such as aerosol dispensers, pressurized beverage containers, or dispensers of the gas, such as, e.g., carbon dioxide fire extinguishers. In particular, the present invention provides an economical, efficient, and environmentally safe system and method for providing a reserve supply of gas in a pressurized container. More specifically, the present invention provides a system and method for providing a reserve supply of gas to restore and maintain propellant pressure as product is depleted from a container, wherein the gas is adsorbed or absorbed on a gas adsorbent or absorbent material and means is provided to promote release of the stored gas from the sorbent material.

In accordance with a preferred embodiment of the invention, a quantity of gas adsorption material is placed in a container, and a quantity of gas, such as, e.g., carbon dioxide, is adsorbed on the material either before or after it is placed in the container. As pressure in the container is depleted during use, a quantity of the sorbed gas is desorbed from the sorbent material and released into the container to maintain pressure in the container within a predetermined range. For example, in containers for pressurized dispensing of a product, the propellant gas in the container may apply to the product a predetermined pressure of from about 30 to about 130 psi, and as this pressure falls off during use of the container, additional gas is released from the storage material into the container to restore the pressure to the desired range.

The adsorbent gas storage material used in the invention is known as a pressure swing adsorption (PSA) system, wherein adsorption of gas into the material occurs at a high pressure, and desorption of gas from the material occurs at a low pressure. Such adsorption/desorption devices are capable of storing under pressure a volume of gas that is 18 to 20 times the volume of the material.

A preferred sorbent material is activated carbon, or a carbon fiber composite molecular sieve (CFCMS) as disclosed, for example, in U.S. Pat. Nos. 5,912,424 and 6,030,698, the disclosures of which are incorporated in full herein. Other materials, such as natural or synthetic zeolite, starch-based polymers, alumina—preferably activated alumina, silica gel, and sodium bicarbonate, or mixtures thereof, may be used to adsorb and store a quantity of a desired gas, although they generally are not as effective as activated carbon. Zeolite is particularly effective at adsorbing and desorbing $CO_2$, especially if calcium hydroxide is added to the zeolite during its manufacture. Other base materials, such as potassium or sodium hydroxide, or lithium hydroxide or sodium carbonate, for example, could be used in lieu of calcium hydroxide.

The sorbent material may be in granular, powdered, or pellet form, or a mass of the material may be formed into variously shaped cohesive bodies, such as balls, tubes, cubes or rods, or sheets or screens which may be flat or curved or folded into various shapes, such as, for example, an accordion-like fold.

One suitable source of granular activated carbon, for example, is a 10×50 mesh material available from Westvaco Corporation under number 1072-R-99. The sorbent material may be enclosed within a rigid or semi-rigid envelope, bag, pouch or packet that is capable of retaining the gas adsorbent material but is permeable to the gas, and is permeable or impermeable to the product.

While the foregoing systems perform better than prior art systems that do not store reserve propellant in a sorbent, applicant has found that the quantity of gas desorbed (such as, e.g., carbon dioxide, nitrous oxide, or oxygen, and the like) is significantly increased when a polar organic fluid such as ethyl alcohol, acetone, water, or the like, or combinations thereof, and/or a surfactant, is added to the sorbent material (e.g., activated carbon, zeolite, or molecular sieve material). If zeolite is used as the sorbent material, water alone is effective to promote release of the sorbed gas. The polar fluid preferably is added in an amount sufficient just to wet the sorbent material. Alternatively, when the sorbent material is placed directly in contact with the product, a separate wetting agent may not be necessary or desired if the product itself contains a polar solvent, e.g., water or alcohol.

Controlling the release of gas is dependent upon the ratio of the quantity of the polar organic fluid to the quantity of sorbent material, and/or by varying the amount of sorbent material relative to the pressure in the container. Further control can be achieved by diluting the polar fluid with water or a non-polar fluid prior to adding the polar fluid to the container. Moreover, if the polar fluid is in gel form, it can take longer for the active component to enter the sorbent material, thus controlling the rate of desorption of the gas.

In a preferred embodiment the polar fluid comprises alcohol diluted with water. The extent of dilution can be selected dependent upon the desired results, but in a preferred embodiment the dilution is 25% alcohol, i.e., one part by weight of alcohol to three parts by weight of water. Of course, the polar fluid could comprise 100% water, or any percentage of polar fluid, e.g., alcohol, or combinations thereof. Release of sorbed gas is more easily controlled when the polar fluid comprises water, but a quicker release of sorbed gas can be achieved when the polar fluid comprises alcohol or a similar material. When the sorbent material comprises activated carbon and is wetted with a polar fluid (e.g., a 25% solution of alcohol and water) at a ratio of 13% polar fluid to sorbent, carbon dioxide release is increased by about 50% relative to conventional systems that do not wet the sorbent material with a polar fluid. Thus, in the system of the invention 90% or more of the sorbed gas is released from the sorbent. Zeolite is particularly effective as a sorbent material, especially in barrier packs, enabling a lesser amount of sorbent to be used. For example, good results are obtained when ½ ounce of zeolite is used as the sorbent in a barrier pack system at 60 psi.

The sorbent material may be pre-charged with the desired gas and then placed in a container, or in communication with the interior of the container, or it may be placed in a non-pressurized container and a desired gas then introduced under pressure into the container after it is sealed to charge the sorbent material for subsequent release of the gas as the propellant or carbonization gas in the container becomes depleted during use, thereby restoring the pressure in the container to a desired level.

For instance, a predetermined quantity of sorbent material can be placed in the container, followed by introduction of the propellant gas, under pressure, until a desired equilibrium pressure is reached in the container (i.e., a quantity of the gas is sorbed on the sorbent material and the pressure in the container is in a desired range, e.g., 100 psi), followed by the addition of a predetermined quantity of a polar fluid sufficient to wet the sorbent material to an extent to achieve the desired result.

In a preferred process for preparing aerosol containers: (1) a predetermined quantity of the gas sorbent material is placed in the container, which has been purged with carbon dioxide; (2) the container is sealed with a valve capable of allowing gases and fluids of a wide viscosity range to be injected into the container either through or around the valve; (3) the container is then subjected to a vacuum of 18-20 mm Hg to remove air and moisture from the container; (4) a predetermined quantity of an adsorbable gas such as carbon dioxide is injected under pressure into the container either through or around the valve; (5) a measured quantity of polar fluid is then placed in the container, in an amount to just wet the sorbent material; (6) product is injected into the container through the valve, which results in a change in the pressure due to the reduction of headspace volume and absorption of carbon dioxide into the product; and (7) the package then comes to equilibrium as formulated for each product. Step (6) may be postponed to a later time or date, if desired.

In lieu of injecting gas into the container as described in step (4) above, a solid form of the propellant (e.g., dry ice) may be placed in the container. The dry ice can be formed in the shape of pellets, tablets, or other shapes as desired or appropriate. The size and quantity of dry ice would be engineered to provide the necessary gas potential to pressurize the container to a desired pressure as the dry ice changes to its gaseous phase, which is then adsorbed onto the adsorbent material. Further, to speed the production process a smaller measured amount of gaseous carbon dioxide can be charged into the container at a higher pressure, equivalent to the quantity desired at a lower pressure, since the carbon dioxide adsorption rate is not instantaneous.

In barrier pack systems, wherein a piston or bag, for example, separates the product from the propellant, a predetermined quantity of the gas sorbent material can be placed in the container by the can manufacturer after the piston or before the bag is positioned. The partially assembled container is then shipped to a location to be filled with product, where the filler injects a measured amount of product into the container above the piston or into the bag, as applicable, seals the container with an appropriate valve, and injects a suitable propellant gas into the container through a self-closing plug in the container bottom to a pressure of 130 psig, for example, whereupon the adsorbent material will adsorb 40 psig, for example. A polar fluid can be added by the filler at this time. As product is expelled during use and the pressure decreases, gas is released from the adsorbent material to restore the pressure in the container to a desired predetermined level.

Nitrous oxide may be used as the sorbed gas in lieu of or in combination with carbon dioxide. Nitrous oxide is more compatible with products having an oil component, for example.

Any desired suitable quantity of the sorbent material may be placed in a container to store and release an appropriate amount of gas to maintain pressure in the container at a desired level during use of the system. Depending upon the starting and ending pressure desired in the container, a quantity of the material equal to 5% to 100% of the quantity of product could be placed in the container. As noted previously herein, some sorbents are more effective at adsorbing the gas. Thus, in one example, satisfactory results are obtained when approximately one-half ounce of zeolite, or one ounce of carbon, is used as the gas adsorption material, charged with a suitable gas and placed in a six-ounce container.

The use of activated carbon to adsorb additional gas in an aerosol container can increase the available gas to a level that results in the pressure remaining more uniform until the product is depleted. This, in turn, maintains a more consistent, uniform and acceptable spray pattern from beginning to end because the pressure at the end is very close to the starting pressure. In some applications, release of make-up gas pressure into the product may be desirable in order to better aerosolize the product throughout the life cycle of the container, or to achieve better foaming, etc.

The adsorbed gas can comprise carbon dioxide alone or in combination with other gases, such as nitrous oxide, or nitrous oxide can be used alone or in combination with other gases, and/or any one or all of these can be used in combination with liquefied compressed gases such as propane, isobutane, dimethyl ether or Dymel® (trademark of DuPont), to produce desired spray patterns which would permit reduction in the quantity of volatile organic compounds used in the pressurized product.

With the barrier pack piston or bag-in-a-can system, $CO_2$ gas can be charged into the product to a pressure lower than the pressure below the piston or outside the bag, dissolving the $CO_2$ in the product. This can be especially beneficial for some products, such as hair spray, since the dissolved $CO_2$ will aid in the break-up of the product when it is sprayed. It would also help reduce clogging of the spray nozzle, for example, by resinous materials. That is, the extra propellant provided by the system of the invention provides benefits in addition to reserve propellant for discharging the product. With the gas storage system of the present invention, the pressure source chamber could be pressurized to 80-100 psig and the product chamber could be pressurized to 50 psig, for example, which pressures would be maintained until the product has been emptied, thereby maintaining a uniform spray pattern throughout the life of the container.

In a system using activated carbon as the sorbent material and carbon dioxide as the gas, when the activated carbon is wetted with a 25% solution of ethyl alcohol and water, at a ratio of 13%, by weight, of alcohol to sorbent material, 78 discharges of 5 seconds duration each can be obtained before the pressure drops to 20 psi, compared with only 20 discharges of 5 second duration each in a system in which the activated carbon is not wetted with the alcohol and water solution.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
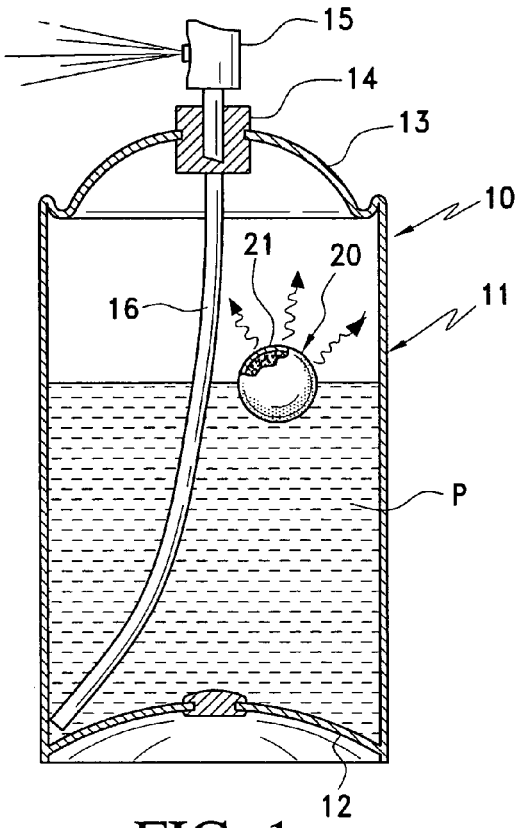
FIG. 1 is a somewhat schematic longitudinal sectional view of a first form of pressurized aerosol dispenser, wherein the dispenser is of the type employing a dip tube, and the gas sorbent material is in the form of a spherically shaped cohesive body or ball.

A first form of aerosol dispenser is indicated generally at 10 in FIG. 1. The dispenser includes a container 11 made of metal or other suitable material, having a bottom 12 and a top 13. A discharge nozzle assembly 14 is mounted on the top and includes a nozzle 15 that may be manually depressed to open and permit product P to be dispensed from the container through the nozzle. A dip tube 16 extends from the bottom of the container to the discharge nozzle assembly. As seen in this figure, the level of product in the container does not occupy the entire volume of the container, and the space above the product level is filled with a pressurized propellant gas to exert pressure on the product and force it through the dip tube and nozzle when the nozzle is depressed. The foregoing structure and operation are conventional, and further detailed description of these basic components and their operation is not believed necessary.

In accordance with the invention, a body 20 of a gas-adsorbing material is placed in the container with the product to adsorb and store a quantity of a desired gas, such as carbon dioxide or nitrous oxide, for example, and to release the stored gas into the container to restore and maintain a desired pressure in the container as the product and/or propellant are depleted. The sorbent material preferably comprises activated carbon, or a carbon fiber composite molecular sieve (CFCMS) as disclosed, for example, in U.S. Pat. Nos. 5,912,424 and 6,030,698, which are incorporated in full herein. Other materials, such as natural or synthetic zeolite, starch-based polymers, activated alumina, silica gel, and sodium bicarbonate, or mixtures thereof, may be used to adsorb and store a quantity of a desired gas, although they generally are not as effective as activated carbon. The material is capable of storing, under pressure, a volume of gas that is many times greater than the volume of the material. For instance, the CFCMS material can hold 40 to 60 times the volume of the body. As disclosed herein, storage of gas on the sorbent material is known as a pressure swing adsorption (PSA) system, wherein adsorption of gas into the sorbent material occurs at a high pressure and desorption of gas from the body occurs at a low pressure. Thus, as the pressure of the propellant gas in the container falls below a predetermined level, gas is released from the sorbent material, restoring the pressure in the container.

Figure 2:
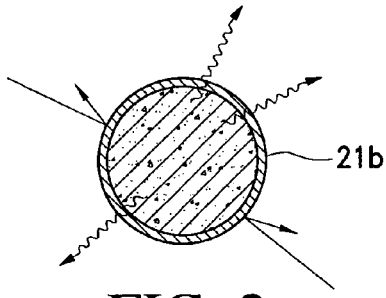
FIG. 2 is an enlarged transverse sectional view of the spherical body of sorbent material of FIG. 1, showing the material enclosed in a gas permeable membrane.

The body 20 may be formed as a cohesive block of activated carbon, or as a carbon fiber composite molecular sieve (CFCMS) material, and may be spherically shaped as shown in the embodiment of FIGS. 1 and 2. The body 20 is placed in the container in contact with the product. A suitable gas (e.g., carbon dioxide) is adsorbed and stored in the body 20 and released to restore pressure in the container as product is dispensed and the pressure in the container drops below a predetermined threshold level.

To promote desorption of the sorbed gas, the sorbent material is wetted with a polar organic solvent. This can be accomplished by wetting the sorbent with a predetermined quantity of the polar solvent, as when the sorbent is contained in a chamber separate from the product, e.g., a barrier pack system, or by wetting of the sorbent through direct contact with the product itself when the product contains a polar solvent. For instance, hairspray is delivered via an alcohol-water system, and if the sorbent is placed in the product it will be wetted by the polar solvent (alcohol and/or water) contained in the hairspray. In a preferred embodiment the polar fluid comprises alcohol diluted with water. The extent of dilution can be selected dependent upon the desired results, but in a preferred embodiment the dilution is 25% alcohol, i.e., one part by weight of alcohol to three parts by weight of water, and the sorbent material comprises activated carbon, the gas comprises carbon dioxide, and the alcohol and water solution is placed in the container at a ratio of 13%, by weight, of the solution to the sorbent material. Of course, the polar fluid could comprise 100% water, or any percentage of polar solvent, e.g., alcohol, or combinations thereof.

Figure 3:
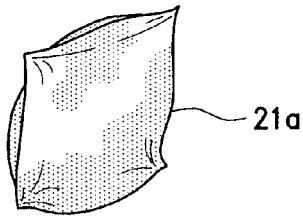
FIG. 3 is a perspective view of a body of sorbent material enclosed in a porous film or cover.

As seen best in FIGS. 2 and 3, a film or cover 21 may be placed around the body of carbon material to prevent dispersion of the carbon into the product, and/or to prevent direct contact between the carbon and product, especially when the sorbent is pre-wetted with a desired amount of polar fluid and further wetting is not desired. That is, the film may comprise a porous member 21*a* (see FIG. 3) that simply contains the carbon material and permits free flow of gas and product, or it may comprise a membrane or film 21*b* (see FIG. 2) that permits flow of gas, e.g., carbon dioxide, outwardly through the film into the product, but prevents flow of product into the material. For example, the film 21*b* may comprise a reverse osmosis membrane placed around the body of material to permit flow of gas from the body into the product, but to prevent flow of product through the membrane to the body.

Figure 4:
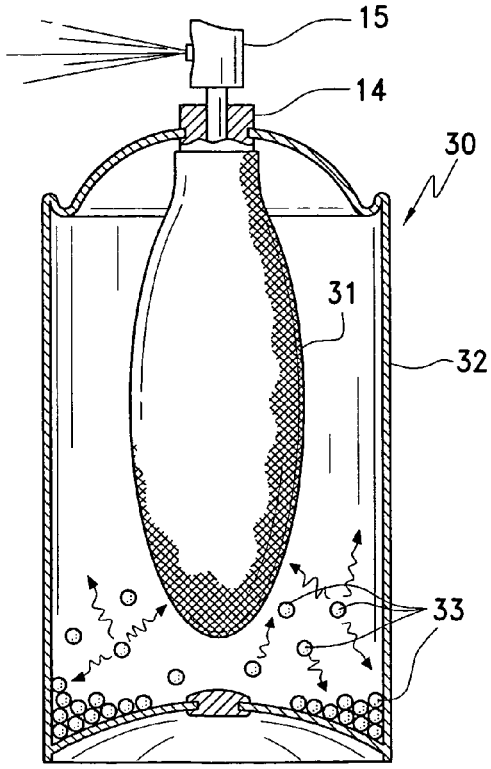
FIG. 4 is a view similar to FIG. 1, but showing a dispenser of the type in which the product to be dispensed is held in a bag in the container, and a granular or pelletized gas sorbent material is employed.

FIG. 4 depicts a pressurized dispenser 30 of the bag-in-a-can type, wherein the product is encased in a bag 31 in the container 32. A sorbent material according to the invention is placed in the container outside the bag, and although the sorbent material may be in any form or shape, as shown in this figure it is in the form of granules or pellets 33. As product is depleted from the bag, the remaining volume of the interior of the container becomes larger, resulting in a decrease in pressure in conventional dispensers. However, in the invention gas is released or desorbed from the sorbent material when the pressure falls to a threshold level, thereby restoring the pressure in the container to a desired level. The quantity of sorbent material, and thus the volume of sorbed gas in the container, can vary depending upon the desired beginning and ending pressure and other desired discharge characteristics.

Figure 5:
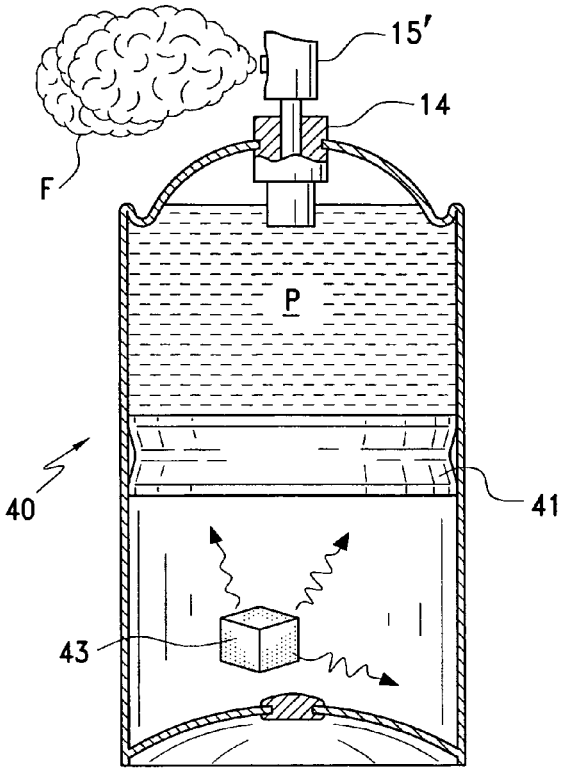
FIG. 5 is a view similar to FIG. 4, but showing a container of the type employing a piston, and wherein the sorbent material is in the form of a cube.

FIG. 5 depicts a pressurized dispenser 40 of the type employing a piston 41 between the product P in the upper part of the container and the propellant beneath the piston in the lower part of the container. A sorbent material according to the invention is placed in the container below the piston, and although the sorbent material may be in any form or shape, as shown in this figure it is in the form of a cube 43. Further, this figure shows the product being dispensed as a foam F rather than as a spray, and a suitable conventional nozzle 15' is selected for that purpose.

Figure 6:
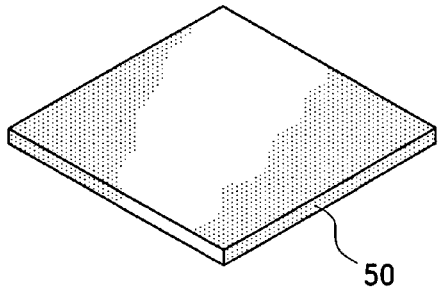
FIG. 6 is a top perspective view of a body of the sorbent material in the shape of a flat sheet.
Figure 8:
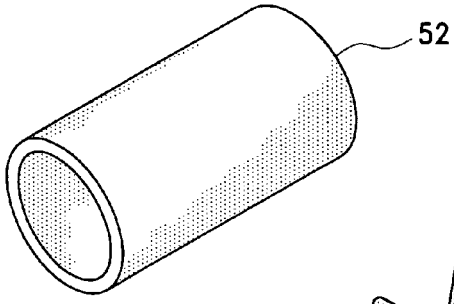
FIG. 8 is a top perspective view of a body of the sorbent material in the shape of a hollow cylinder or tube.
Figure 7:
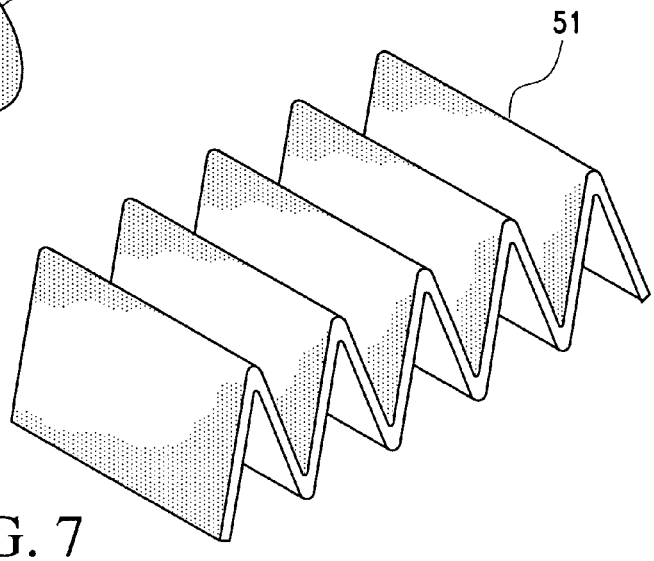
FIG. 7 is a top perspective view of a body of the sorbent material in the shape of an accordion-pleated sheet.

Several examples of the variations in shape that the body of sorbent material can take are shown in FIGS. 6-8. In FIG. 6, the body is in the form of a flat sheet 50; in FIG. 7 the body is in the form of an accordion-folded sheet 51; and in FIG. 8 the body is in the form of a hollow tube or cylinder 52.

Figure 9:
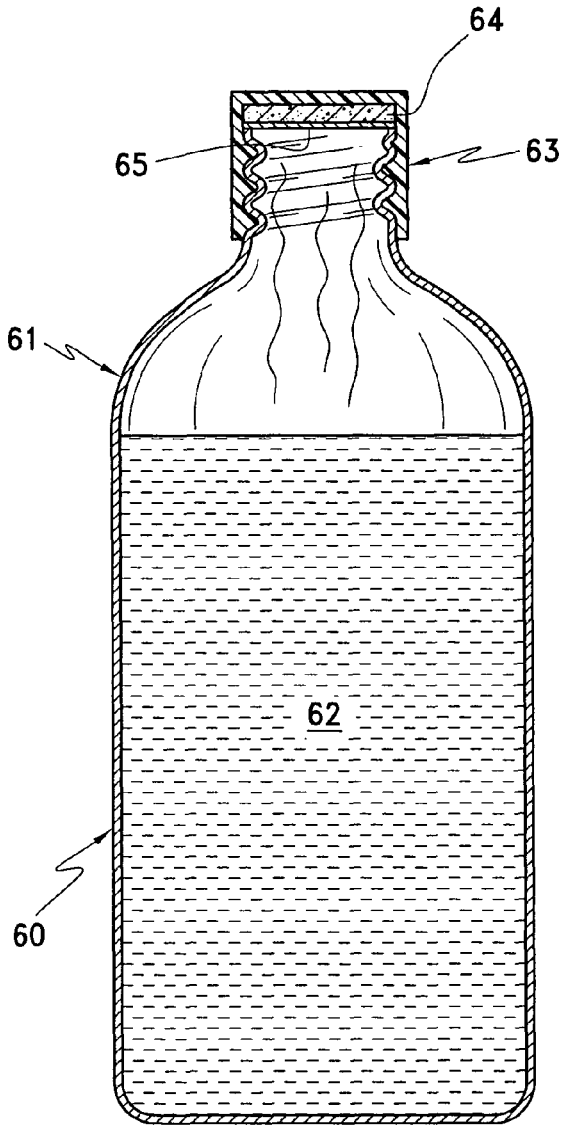
FIG. 9 is a somewhat schematic longitudinal sectional view of a beverage bottle containing a beverage, and having a gas storage and release system according to the invention incorporated into the cap.
Figure 10:
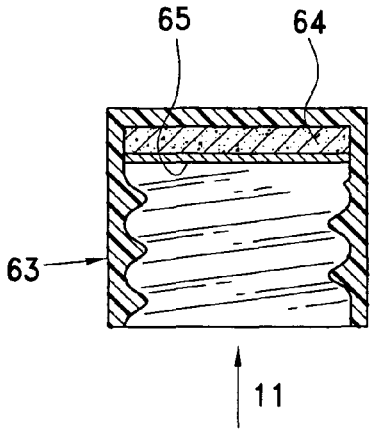
FIG. 10 is an enlarged longitudinal sectional view of a bottle cap incorporating the gas storage and release system of the invention.
Figure 11:
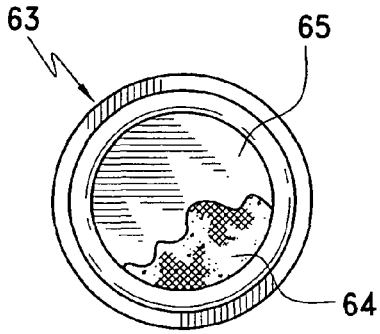
FIG. 11 is an end view of the cap of FIG. 10, looking in the direction of the arrow 11, with portions broken away for sake of illustration.

Use of the invention to store and release gas into a beverage is shown generally at 60 in FIGS. 9-11. In this embodiment, a beverage bottle 61 has a quantity of beverage 62 therein, and a closure cap 63 placed on the end of the bottle. In accordance with the invention, a body 64 of a sorbent material such as activated carbon, or carbon fiber composite molecular sieve (CFCMS) material, or zeolite, or the like, is placed in the cap. If desired, the body may be isolated from the interior of the bottle by a suitable film or cover, such as reverse osmosis membrane or gas permeable membrane 65.

If the beverage is a carbonated beverage, the body may store a quantity of $CO_2$, which is released from the body into the container to restore pressure in the container, and $CO_2$ into the beverage, lost due to depletion of the beverage and the $CO_2$, or permeation of the $CO_2$ through the container wall.

The beverage may also comprise water, or a sports drink, and the gas can comprise $O_2$, to give a boost of energy to a person drinking from the bottle.

Figure 12A:
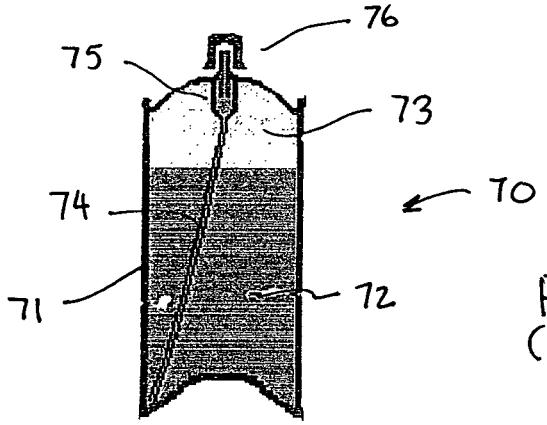
FIG. 12a (PRIOR ART)
FIGS. 12*a*-12*f* are somewhat schematic longitudinal sectional views depicting a conventional filling process of an aerosol container.

Referring to FIGS. 12*a*-12*f*, a process for filling a conventional aerosol container is shown. FIG. 12*a* depicts a conventional aerosol container 70 and its component parts, assembled and ready to use. This system comprises an aerosol can 71 holding a quantity of product and liquid propellant 72, with a head space 73 above the product containing propellant vapor under pressure for dispensing the product through a dip tube 74, valve 75, and actuator 76.

Figure 12B:
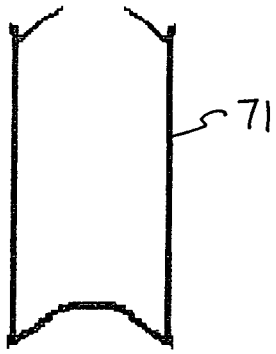
FIG. 12b (PRIOR ART)
Figure 12C:
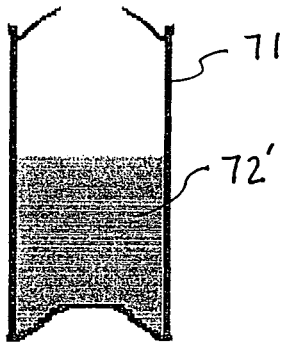
FIG. 12c (PRIOR ART)
Figure 12D:
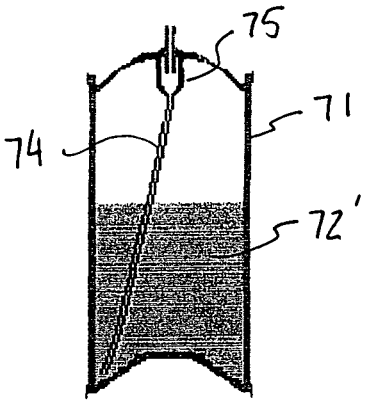
FIG. 12d (PRIOR ART)
Figure 12E:
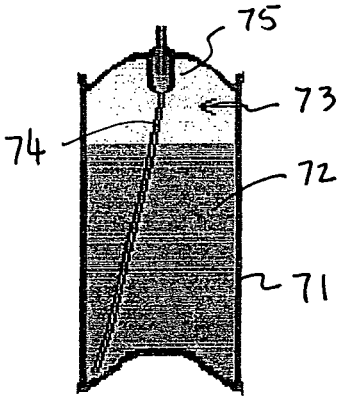
FIG. 12e (PRIOR ART)

FIGS. 12*b* through 12*f* depict the steps and sequence of steps involved in adding product and propellant to the container. In step one, the process starts with an empty aerosol container 71 made of tinplate, aluminum, or plastic, as shown in FIG. 12*b*. In step two, the product 72', usually in the form of a liquid containing all of the ingredients except propellant, is then added to the container as shown in FIG. 12*c*. In step three, as shown in FIG. 12*d*, the dip tube 74 and aerosol valve 75 are fitted (crimped) to the can. If a small actuator 76 is to be used, it can be fitted onto the valve before the valve is crimped onto the can, or it can be applied later. In step four, propellant is then injected through the valve, under pressure. The propellant may be in the form of a liquefied gas or a compressed gas. If a liquefied gas, it will exist as both a liquid in the product and a vapor in the head space 73. As depicted in FIG. 12*e*, the volume of liquid in the can thus will increase relative to the volume following step two. If a compressed gas is used, it usually will exist only in the head space above the product, and there will be little or no increase in the liquid volume in the can. The aerosol is now in a pressurized state, and the cans are immersed in a water bath at 50° C. to check for leaks.

Figure 12F:
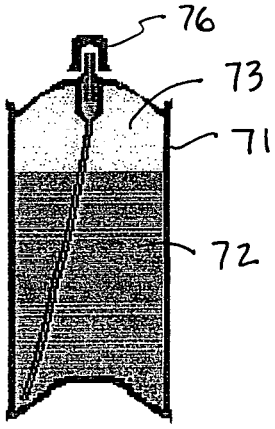
FIG. 12f (PRIOR ART)

If a large, or special, actuator is required it will be fitted at this time, as depicted in FIG. 12*f*. The can is then dated, batch coded, and shrink wrapped or boxed, as required.

Figure 13A:
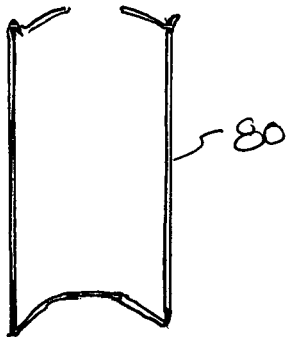
FIGS. 13*a*-13*f* are somewhat schematic longitudinal sectional views depicting the filling process according to the invention for an aerosol container.
Figure 13B:
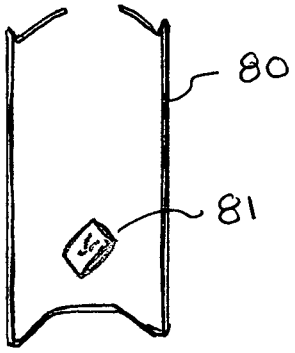
Figure 13C:
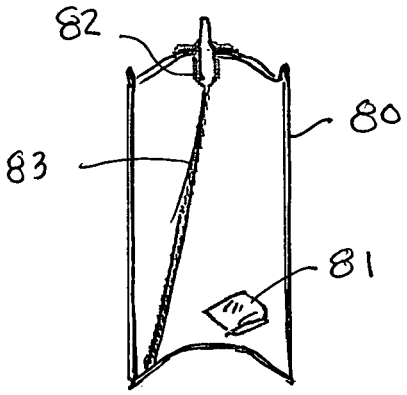
Figure 13D:
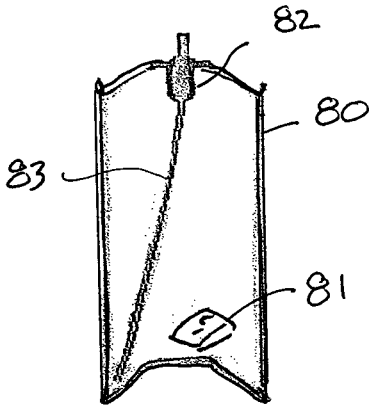
Figure 13E:
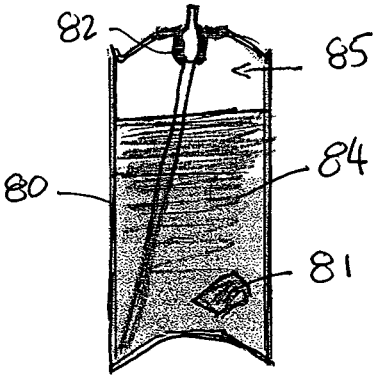
Figure 13F:
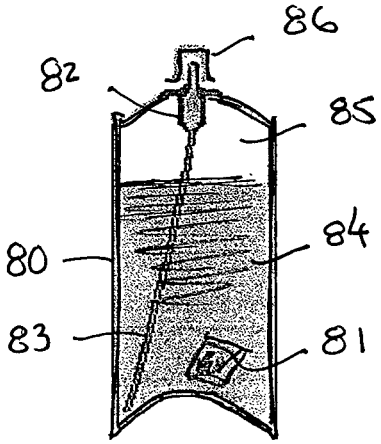
Figure 14A:
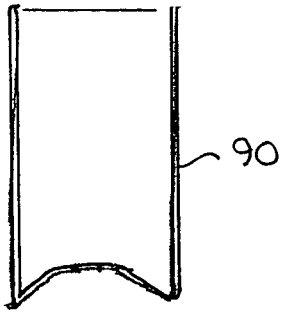
FIGS. 14*a*-14*f* are somewhat schematic longitudinal sectional views depicting the filling process according to the invention for a barrier pack piston.
Figure 14B:
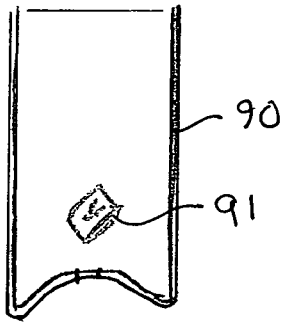
Figure 14C:
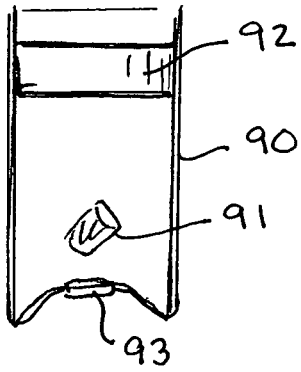
Figure 14D:
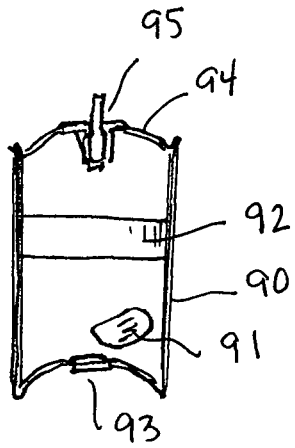
Figure 14E:
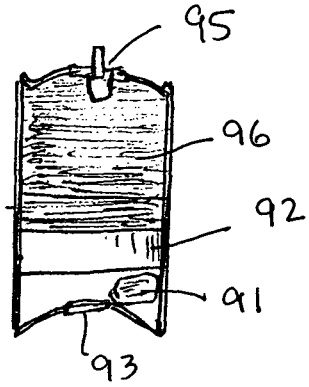
Figure 14F:
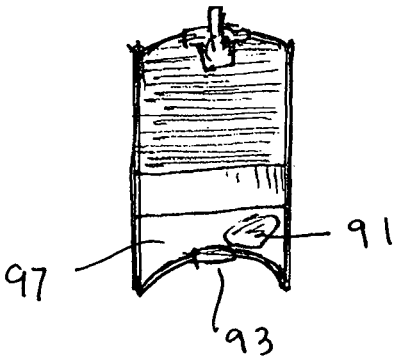
Figure 15A:
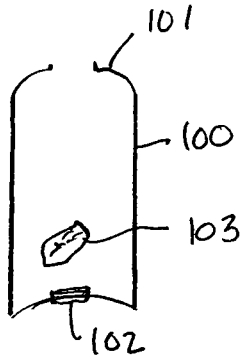
FIGS. 15*a*-15*d* are somewhat schematic longitudinal sectional views depicting the filling process for a bag-in-a-can.
Figure 15B:
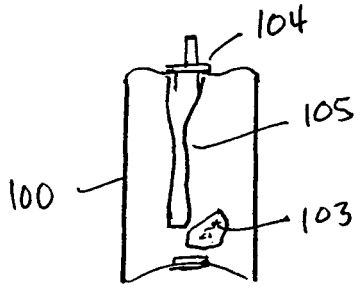
Figure 15C:
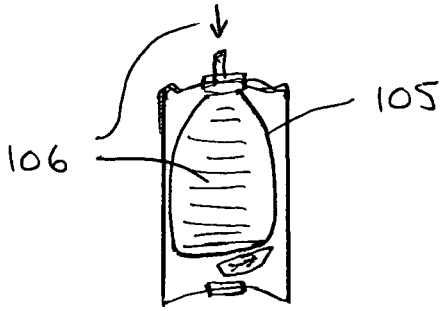
Figure 15D:
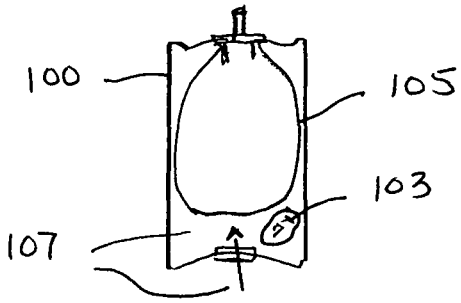

FIGS. 13*a* through 13*f* depict the steps and sequence of steps involved in one process for filling an aerosol container in accordance with the invention. In step one, an empty aerosol can 80 is provided as depicted in FIG. 13*a*. However, as distinguished from the conventional filling process, in step two a predetermined quantity of gas adsorbing material 81 (e.g., activated carbon) is first added to the empty can, followed by fitting the valve 82 and dip tube 83 in step three as depicted in FIG. 13*c*. In step four the propellant (e.g., $CO_2$) is injected under pressure through the valve and adsorbed on the gas adsorbent material 81, as depicted in FIG. 13*d*, followed by the addition of a polar fluid such as, e.g., alcohol, water, or the like, in an amount sufficient to wet the adsorbent material 81. In a specific example, a 25% solution of alcohol diluted with water is added in an amount equivalent to 13%, by weight, of the adsorbent material. In step five, product 84, usually in the form of a liquid and containing all the active ingredients, is then added through the valve. Before the product is placed in the container it is desirable to pre-charge or pre-gas it with at least a quantity of propellant sufficient to prevent initial release or loss of some of the stored gas from the sorbent material when the product is initially placed in the container. The product can be pre-charged or pre-gassed in an inline process, or in a batch process in a pressurized tank, for example. The gaseous propellant, or most of it, previously introduced into the can, is compressed into the head space 85. The container is now in a pressurized state, and is further processed the same as conventional aerosol containers, as described above, including the addition of an actuator 86 as shown in FIG. 13*f*.

A similar process is followed in filling a barrier pack according to the invention, as depicted in FIGS. 14*a* through 16*b*, for example, wherein a piston or bag in the can separates the product from the propellant.

Thus, with reference to FIGS. 14*a*-14*f*, an empty can 90 made of tinplate, aluminum or plastic is made by the can manufacturer. The gas adsorbent material 91 is then placed in the can, followed by addition of the piston 92 and a gas injection plug 93 in the can bottom. The domed end 94 and valve 95 are then placed on the upper end of the can, and product 96 is introduced through or around the valve. Propellant 97 is then injected under pressure through the plug in the can bottom, followed by the addition of a polar fluid as described above.

In a seamed three-piece steel can, the top dome would be seamed on the can, followed by insertion of the piston through the open bottom, followed by introduction of the sorbent material beneath the piston, after which the bottom dome, with the injection valve in place, would be seamed onto the bottom end of the can. The assembled can would then be sent to a filler for further processing.

The filling process for a bag-in-a-can is depicted in FIGS. 15*a*-15*d*. Thus, a tinplate can 100 is produced by the can manufacturer with a partially necked down upper end 101 and a plug 102 in the can bottom. A pouch of gas adsorbent material 103 is placed in the can, and the valve 104 and bag 105 are then assembled to the partially necked down upper end. The can manufacturer then ships the assembled can to a filler, who adds product 106 through the valve (FIG. 15*c*), and charges the can through the bottom plug with $CO_2$ propellant 107 (FIG. 15*d*), followed by the addition of a polar fluid as described above.

Figure 16A:
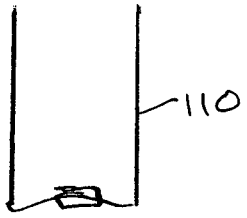
FIGS. 16*a*-16*c* are somewhat schematic longitudinal sectional views depicting the filling process for a piston in an aluminum can.
Figure 16B:
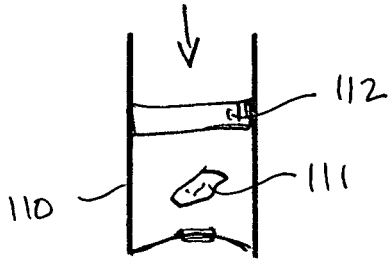
Figure 16C:
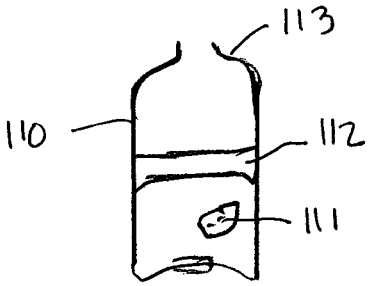

Filling of an aluminum can having a piston is depicted in FIGS. 16*a* through 16*c*. Thus, the can manufacturer forms the can 110 to the shape shown in FIG. 16*a*, then adds the gas adsorbent material 111 and piston 112 through the top of the can. The can manufacturer then forms the shoulder and neck 113 of the can to the shape shown in FIG. 16*b*, and ships the thus assembled can to a filler, with the gas adsorbent material and piston installed and the can ready to be filled. The filler then fills the can to the desired level with product, introduced through the neck 113, and installs the valve and crimps it to the neck of the can (not shown). Propellant, e.g., $CO_2$ gas is then charged under pressure into the can through the bottom plug 114, followed by introduction of a polar fluid as described above. Note: the steps not shown are essentially as previously shown and described.

While the invention may be practiced satisfactorily without the addition of a polar fluid, applicant has found that substantially improved performance is achieved when a polar fluid is added. The polar fluid promotes release or desorption of the adsorbed gas from the sorbent material, whereby all or substantially all of the propellant is released from the sorbent material. This significantly improves the efficiency of the system, and can permit the use of less sorbent material and less propellant while still obtaining a satisfactory operative system.

While particular embodiments of the invention have been illustrated and described in detail herein, it should be understood that various changes and modifications may be made to without departing from the spirit and intent of the invention.

What is claimed is:

1. A gas storage and delivery system for restoring pressure as it is depleted from a pressurized container, comprising:

a container holding a product under pressure to be dispensed from the container, said container having a normally closed discharge valve through which said product is dispensed when the valve is opened;

a quantity of gaseous material under pressure in the container, occupying a space in the container and applying to the product a predetermined pressure of from about 30 to about 180 psig to discharge product from the container when the valve is opened, said gaseous material comprising one of carbon dioxide and nitrous oxide;

a quantity of gas-adsorbing material in the container, said gas adsorbing material comprising one of activated carbon, zeolite, alumina, and a carbon fiber composite molecular sieve;

a reserve supply of gaseous material adsorbed on the gas-adsorbing material, said reserve supply of gaseous material being desorbed from the gas-adsorbing material and released into the container in response to a decrease in pressure in the container, thereby restoring and maintaining a predetermined pressure in the container as product is depleted from the container; and wherein said gas-adsorbing material is pre-wetted with a release-promoting agent at the time of manufacture of the container to cause desorption of at least about 90 percent of the sorbed gas from the gas-adsorbing material during use of the system.

2. A gas storage and delivery system as claimed in claim 1, wherein:

the release-promoting agent is a polar fluid.

3. A gas storage and delivery system as claimed in claim 2, wherein:

the polar fluid comprises alcohol diluted with water to form a solution containing 25% alcohol; and the polar fluid is added to the container in the ratio of 13%, by weight, of polar fluid to adsorbent material.

4. A gas storage and delivery system as claimed in claim 1, wherein:

the gas adsorbing material is in the form of a unitary cohesive body of material that retains its shape in the container, said cohesive body of material being in direct contact with the product.

5. A gas storage and delivery system as claimed in claim 1, wherein:

the gas adsorbing material is in granular or powdered form.

6. A gas storage and delivery system as claimed in claim 5, wherein:

the gas adsorbing material is in the product; and a film or membrane cover is placed around the gas adsorbing material to prevent dispersal of it into the product but to enable flow of the stored gaseous material from the gas adsorbing material into the product.

7. A gas storage and delivery system as claimed in claim 6, wherein:

the film or membrane cover prevents contact between the gas adsorbing material and the product; and the release-promoting agent is not the product in the container.

8. A gas storage and delivery system as claimed in claim 1, wherein:

the gas adsorbing material is in the form of pellets.

9. A gas storage and delivery system as claimed in claim 4, wherein:

the gas-adsorbing material is one of natural and synthetic zeolite.

10. A gas storage and delivery system as claimed in claim 1, wherein:

the product and gaseous material are together in the container, with said space comprising a head space above the product; and a dip tube extends from the discharge nozzle into the product.

11. A gas storage and delivery system as claimed in claim 1, wherein:

a bag divides the interior of the container into a product chamber inside the bag and a propellant chamber outside the bag, and said product is in the product chamber and said gaseous material and gas adsorbing material are in the propellant chamber.

12. A gas storage and delivery system as claimed in claim 1, wherein:

a piston divides the container into an upper portion and a lower portion; and the product is in the upper portion and the gaseous material and gas adsorbing material are in the lower portion.

13. A gas storage and delivery system as claimed in claim 1, wherein the release-promoting agent is a non-polar fluid.

14. A process for pressurizing and filling a pressurized container with a product to be dispensed under pressure from the container and a pressurized gaseous material for pressurizing the product, comprising the steps of:

placing in the container a predetermined quantity of gas-adsorbing material that adsorbs and stores a desired volume of the gaseous material under a predetermined pressure and releases the gaseous material when pressure falls below a predetermined level, said gas-adsorbing material comprising one of activated carbon and zeolite;

placing in the container a quantity of the gaseous material under pressure sufficient to prevent initial release of some of the adsorbed gas from the gas-adsorbing material prior to use of the container, said gaseous material comprising one of carbon dioxide and nitrous oxide;

placing a predetermined quantity of a release-promoting agent in the container in an amount to wet the gas-adsorbing material for causing release of about 90 percent of the gaseous material from the gas-adsorbing material as gaseous material is desorbed from the gas-adsorbing material during use of the container; and thereafter placing product in the container.

15. A process as claimed in claim 14, wherein:

the desired volume of gaseous material is adsorbed on the gas adsorbing material after the gas adsorbing material is placed in the container, by adsorption of at least a portion of the gaseous material placed in the container.

16. A process as claimed in claim 14, wherein:

the desired volume of gaseous material is adsorbed on the gas-adsorbing material before the gas-adsorbing material is placed in the container.

17. A process as claimed in claim 14, wherein:

the gas-adsorbing material comprises activated carbon, the gaseous material comprises carbon dioxide, and the release-promoting agent comprises a polar fluid.

18. A process as claimed in claim 17, wherein:

the polar fluid comprises alcohol diluted with water to form a solution containing 25% alcohol; and the alcohol and water solution comprises 13%, by weight, of the gas-adsorbing material.

19. A gas storage and delivery system for restoring pressure as it is depleted from a pressurized container, comprising:

a container holding a product under pressure to be dispensed from the container;

a quantity of gaseous material under pressure in the container with the product, occupying a space in the container and applying to the product a predetermined pressure of from about 30 to about 180 psig; and a quantity of gas-adsorbing material in the container with the product in direct fluid contact with the product, a quantity of the gaseous material being adsorbed on the gas-adsorbing material and desorbed from the gas-adsorbing material and released into the container in response to a decrease in pressure in the container, thereby restoring and maintaining a predetermined pressure in the container as product is depleted from the container, said gas-adsorbing material comprising one of activated carbon, zeolite, alumina, and a carbon fiber composite molecular sieve, and being wetted with a release-promoting agent prior to addition of product to the container to cause release of about 90 percent of the sorbed gas during use of the system.

20. A gas storage and delivery system as claimed in claim 19, wherein:

the gas-adsorbing material comprises a unitary cohesive body of the material having a shape selected from the group consisting of a cube, a sphere, a flat panel, an accordion-pleated panel, and a hollow cylindrical body.

21. A gas storage and delivery system as claimed in claim 19, wherein:

said gas-adsorbing material is wetted with said release-promoting agent at the time it is introduced into the container during manufacture of the gas storage and delivery system to promote desorption of the sorbed gas from the gas-adsorbing material during use of the system.

22. A gas storage and delivery system as claimed in claim 19, wherein:

said gas-adsorbing material is in one of a granular or powdered form; and a film or membrane cover is placed around the gas-adsorbing material to prevent dispersal of it into the product but to enable flow of the stored gaseous material from the gas-adsorbing material into the product.

23. A gas storage and delivery system for restoring pressure as it is depleted from a pressurized container, comprising:

a container holding a product under pressure to be dispensed from the container, said container having a normally closed discharge valve through which said product is dispensed when the valve is opened;

a quantity of gaseous material under pressure in the container, occupying a space in the container and applying to the product a predetermined pressure of from about 30 to about 180 psig to discharge product from the container when the valve is opened;

a quantity of gas-adsorbing material in the container;

a reserve supply of gaseous material adsorbed on the gas-adsorbing material, said reserve supply of gaseous material being desorbed from the gas-adsorbing material and released into the container in response to a decrease in pressure in the container, thereby restoring and maintaining a predetermined pressure in the container as product is depleted from the container; and wherein said gas-adsorbing material is wetted with a polar fluid as a release-promoting agent at the time of manufacture of the container to promote desorption of all or substantially all of the sorbed gas from the gas-adsorbing material during use of the container, said polar fluid comprising alcohol diluted with water to form a solution containing 25% alcohol, said polar fluid being added to the container in the ratio of 13%, by weight, of polar fluid to adsorbent material.

24. A process for pressurizing and filling a pressurized container with a product to be dispensed under pressure from the container and a pressurized gaseous material for pressurizing the product, comprising the steps of:

placing in the container a predetermined quantity of gas-adsorbing material that adsorbs and stores a desired volume of the gaseous material under a predetermined pressure and releases the gaseous material when pressure falls below a predetermined level;

placing in the container a predetermined quantity of the gaseous material under pressure;

placing a predetermined quantity of a release-promoting agent in the container in an amount to wet the gas-adsorbing material for promoting release of all or substantially all of the gaseous material from the gas-adsorbing material as gaseous material is desorbed from the gas-adsorbing material during use of the container, said release-promoting agent comprising a polar fluid, wherein the polar fluid comprises alcohol diluted with water to form a solution containing 25% alcohol and the alcohol and water solution comprises 13%, by weight, of the gas-adsorbing material; and thereafter placing product in the container.

* * * * *